United States Patent [19]

Melhus et al.

[11] Patent Number: 4,756,252

[45] Date of Patent: Jul. 12, 1988

[54] DEVICE FOR REDUCING THE BASE RESISTANCE OF AIRBORNE PROJECTILES

[75] Inventors: Ulf Melhus; Lennart Johansson; Arne Franzén; Boo Bolinder, all of Karlskoga, Sweden

[73] Assignee: Aktiebolaget Bofors, Bofors, Sweden

[21] Appl. No.: 313,925

[22] Filed: Oct. 22, 1981

[30] Foreign Application Priority Data

Oct. 28, 1980 [SE] Sweden ..... 8007549

[51] Int. Cl.[4] ..... F42B 15/10

[52] U.S. Cl. ..... 102/374; 102/501

[58] Field of Search ..... 102/374, 375, 376, 381, 102/501, 503; 244/3.22, 3.3

[56] References Cited

U.S. PATENT DOCUMENTS

| | | | |
|---|---|---|---|
| 3,273,334 | 9/1966 | Tanczos et al. | 60/270.1 |
| 3,698,321 | 10/1972 | Wall | 102/49.3 |
| 3,988,990 | 11/1976 | MacDonald, Jr. et al. | 102/49.7 |
| 4,091,731 | 5/1978 | Schadow et al. | 102/372 |
| 4,091,732 | 5/1978 | Schadow | 102/374 |
| 4,213,393 | 7/1980 | Gunners et al. | 102/374 |

FOREIGN PATENT DOCUMENTS

| | | | |
|---|---|---|---|
| 2155787 | 5/1973 | Fed. Rep. of Germany . | |
| 2547528 | 4/1977 | Fed. Rep. of Germany . | |
| 2804270 | 8/1979 | Fed. Rep. of Germany . | |
| 1257613 | 2/1961 | France | 102/381 |
| 138671 | 11/1975 | Norway . | |
| 543737 | 3/1942 | United Kingdom . | |
| 975086 | 3/1962 | United Kingdom . | |
| 1008574 | 10/1964 | United Kingdom . | |
| 1317032 | 5/1973 | United Kingdom . | |
| 1440560 | 6/1976 | United Kingdom . | |

*Primary Examiner*—Donald P. Walsh

*Attorney, Agent, or Firm*—Pollock, Vande Sande & Priddy

[57] ABSTRACT

The invention deals with a method of eliminating the base resistance of a flying object. Included in the invention is a device specially adapted to the method. According to the invention base resistance is eliminated by means of the combustion gases from a combustion chamber (2) built into the object being released from the said chamber and led towards the base surface of the object via devices (9–16, 20, 24 and 30) which eliminate the greater part of the gases' motive energy before or simultaneously with their reaching an outlet located on the base surface of the object through which they are allowed to flow out under such conditions that the base resistance of the object (1, 26) is at least partly eliminated.

7 Claims, 3 Drawing Sheets

DEVICE FOR REDUCING THE BASE RESISTANCE OF AIRBORNE PROJECTILES

Within the field of artillery techniques there has been a continual striving to increase the range and precision of field guns. Increased range is achieved either by gun improvements, which even include such modifications to propellant charges that a redesign of gun parts is required due to for example increased gas pressure in the barrel, or by improvements in the projectile performance. The turnover time for gun parts in the meantime is long, and therefore it is more attractive to attempt to improve the performance of the projectile itself without altering the gun as the ammunition has a continual turnover time of a totally different character to that of the gun.

Improved projectile performance can be achieved in several different ways which to a certain extent can be combined in one and the same projectile. At present work is proceeding along three different lines, of which the first involves attempting to produce a low-resistance projectile where the air resistance is reduced to a minimum. This work has resulted in longer and slimmer projectiles. The second line involves equipping special projectiles with their own source of power in the form of a built-in rocket motor, so-called "reatiles" or Rocket Assisted Projectile (RAP). With regard to the third line, the work has been concentrated around reducing the base resistance of the projectile, caused by the stream of air round the projectile generating a lower pressure immediately behind the projectile base than in the surrounding air.

It is known that theoretically this base resistance can be reduced or even eliminated by allowing a stream of gas to flow out of the base surface of the projectile in a suitable manner, thereby increasing the base pressure. This base pressure can be further increased if the stream of gas is combined with the release of heat. The effect produced by this, the so-called base-bleed effect, differs from purely rocket power in as much as the flow generated is so low that the reaction force generated by the flow is practically negligible when compared with the change in pressure affecting the projectile base. The problem with producing a satisfactory base-bleed projectile has been predominently on the practical level. The necessity for a long burning time and a subdued gas outflow has caused attempts to be made to produce slow burning powder charges which ran towards the base surface of the projectile via a relatively large gas outlet opening. Consequently it has been a problem to produce sufficiently slow burning powder charges which in addition did not disintegrate under the aggregate influence of all the forces affecting the projectile. Slow burning powder charges for earlier actual base-bleed type projectiles even suffer from the fact that powder charges which are open to the surrounding atmosphere via a relatively large outlet opening will burn at varying speeds at different external pressures, i.e. the speed of burning will vary according to the trajectory height.

With the present invention we have now produced a base resistance eliminator which is independent of the flight height of the projectile, and due to an improved air mixture gives an improved utilization of that powder charge which can be carried in the projectile. A further advantage of the base resistance eliminator as described in the invention is that as a rule it does not require a special ignition system as has been necessary with previous slow burning base-bleed powder charges. These previous constructions have indeed been ignited by the powder gases when the projectile was fired, but then were extinguished by the rapid drop in pressure when the projectile left the gun barrel. The invention includes such solutions as can be utilized for projectiles having their own source of power, for example missiles, which with regard to the guidance system used or for other reasons are constructed with a more or less sheer base which produces an undesired base resistance.

According to the invention combustion gases are discharged from a combustion chamber in which a propellant powder or other propellant fuel is burned under such conditions that the combustion gases leave the combustion chamber at a critical speed, that is to say, faster than the speed of sound. After leaving the combustion chamber the gases lose most of their motive energy, that is to say, their speed of flow is reduced to such a degree that the outflowing gases impart in principle no real motive power when they are released from the projectile or rocket at a level even with its base surface. It is possible to impair the motive energy of the combustion gases in several ways. One way which has been shown to be successful is to force the gases to change direction under such conditions that they are mixed effectively with the surrounding atmosphere. Another way is to allow the critically flowing exhaust gases to flow out into a chamber of great volume in relation to the amount of out-flowing gas. The chamber in turn shall have through-contact with the surrounding atmosphere via one or more outlet openings.

This invention deals with hot combustion gases which are braked preferably against a baffle built into the object in question, this baffle being defined as a flame divider. If this flame divider is formed in such a way that a good mixing of the combustion gases is achieved with the surrounding air, advantage can be taken of the previously mentioned known increase in the base pressure which is gained when heat is released.

In general the invention can be considered to mean that under relatively high pressure, combustion gases are generated which during their critical flow are drained from the combustion chamber, after which most of the motive energy is removed from the outflowing combustion gases which are then led away from the base surface of the projectile (object) at a very low speed completely in accordance with previously known techniques. This means that the method described by the invention is not restricted to the use of specially low pressure burning powder but can in principle utilize a completely conventional very small rocket motor in which the outflowing motive energy of the combustion gases is nullified.

The invention is defined in the patent claims and will now be somewhat further described by a few differing examples.

The FIGS. 1–8 show a cross-section through the rear part of an artillery shell equipped with a base resistance eliminator in accordance with the submitted invention.

FIG. 9 in cross-section shows a rocket equipped with an equivalent base resistance eliminator.

In the FIGS. 1–8, 1 indicates the rear part of a shell body comprising a combustion chamber 2 with a propellant charge 3 for the base resistance eliminator. The combustion gases generated by the propellant charge 3 leave the combustion chamber 2 via a nozzle 4. Between the rear of the propellant charge 3 and the nozzle (nozzles) 4 there is an air space 2' as shown in FIGS. 5–8.

In the FIGS. 1–7 can be seen the forward shell body 5 with its explosive charge 6 in front of the rear shell body 1. The shell girdle is denoted as 7. The nozzle 4 is located in the partition wall 8 which encloses the combustion chamber 2.

In the various shells as shown in FIS. 1–8 different methods of slowing down the motive energy of combustion gases are utilized.

In the variation shown in FIG. 1, this takes place by means of the combustion gases being allowed to stream out into a, in relation to the gas quantity, relatively capacious chamber 9 formed by the extended side walls of the shell. In the variation shown in FIG. 2, the speed of the gas is further slowed down by means of the chamber 9 being equipped with a rear wall 10 which in turn is equipped with a number of axial outlet openings 11 arranged radially outside the nozzle 4.

Figure 5:
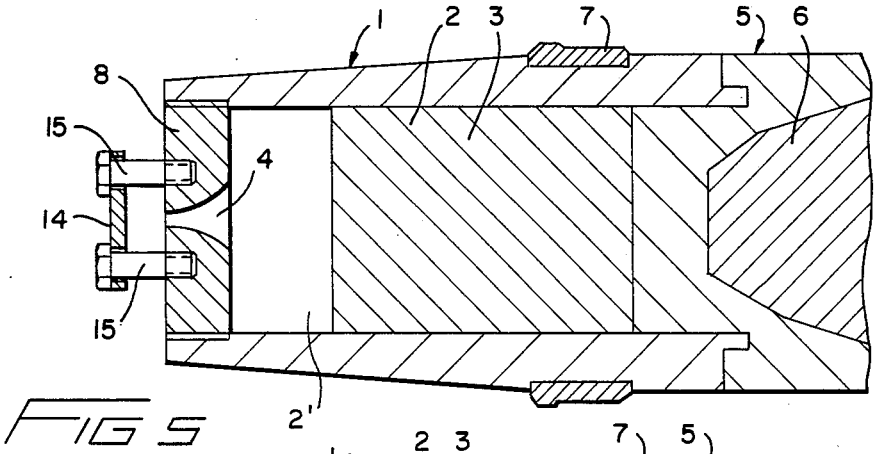

FIG. 5 should be considered primarily as a suggestion for that variation where the combustion gases have their motive energy removed by a baffle or flame divider 14 located immediately behind the base surface of the shell. This theoretical construction gives a very good air mixture and is therefore as previously mentioned, theoretically very effective. The baffle 14 is held in place by bolts 15.

Figure 1:
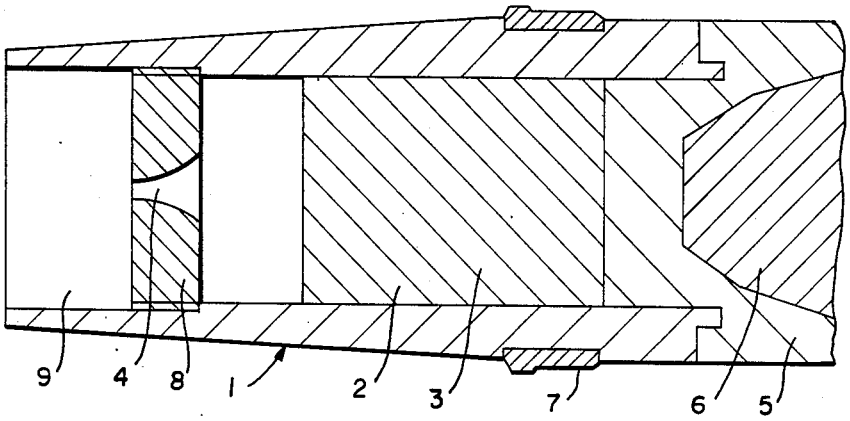
Figure 2:
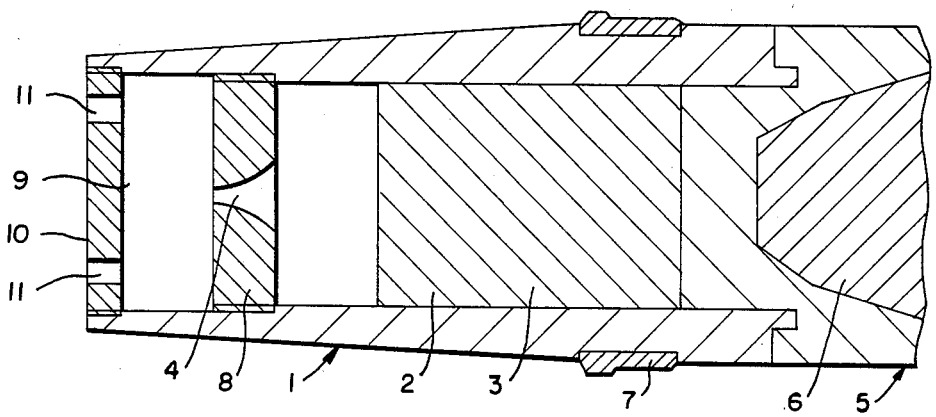
Figure 3:
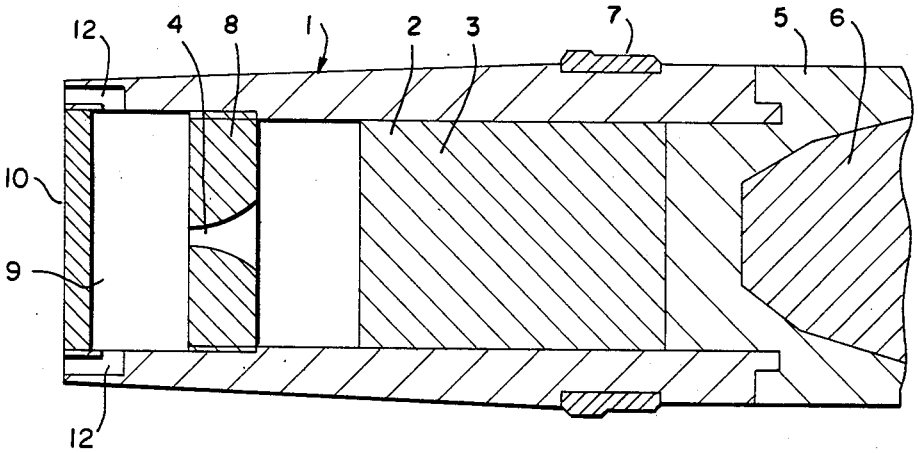
FIG. 3 shows another method of arranging these outlet openings which in this case are denoted 12. The openings 12 compel the combustion gases to a further change in direction in order to remove from them their motive energy.
Figure 4:
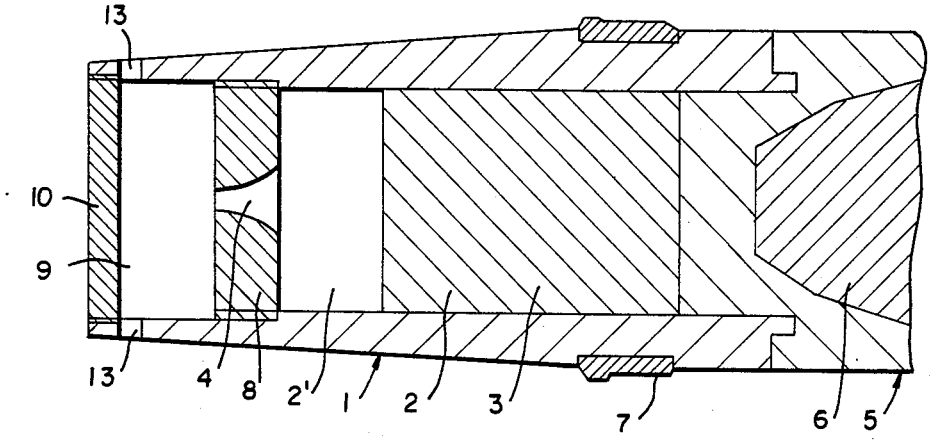
FIG. 4 shows a variation with radial outlet openings 13 arranged adjacent to the base surface of the shell.

FIG. 5 shows what is in practice a more suitable design constructed in accordance with the principles for the flame divider as shown in FIG. 4. In this case, the baffle consists of a socket 16 equipped with a base-plate 17 and screwed into a hole in the shell base. The socket base-plate 17 functions as a baffle for the purpose of slowing down the speed of the gases while the side walls 18 of the socket show a number of outlet openings 19. The socket 16 with its base-plate 17 and radial outlets 19 effectively brakes the speed of the gas and gives a good mixture of the surrounding atmosphere with the powder gases. This produces an effective flame division.

Figure 7:
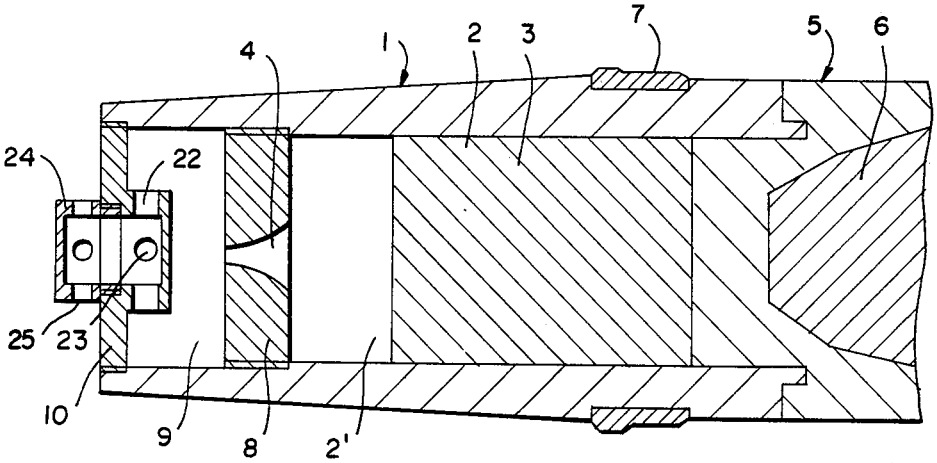

FIG. 7 shows another variation of the alternative shown in FIG. 5. In this case the combustion gases are allowed to stream directly out of the nozzle 4 into a reinforced flame divider socket 20 which is formed in principle in the same way as the flame divider socket 16. In this case, the outflow openings are denoted 21. The advantage of this design compared with that shown in FIG. 5 is that the chamber 9 is eliminated which allows less of the projectile length to be used for the base resistance eliminator.

Figure 6:
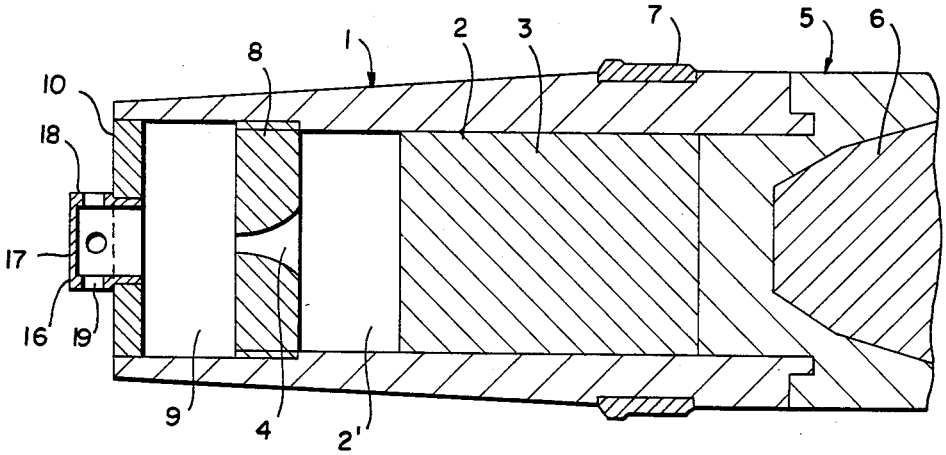

FIG. 6 shows another variation of the same principle where the combustion gases are compelled to change direction twice, firstly via radial openings 22 inside an intermediate chamber 23 and secondly from this chamber down into a socket 24 of the same design as that in FIG. 5 and out via radial openings 25.

Figure 8:
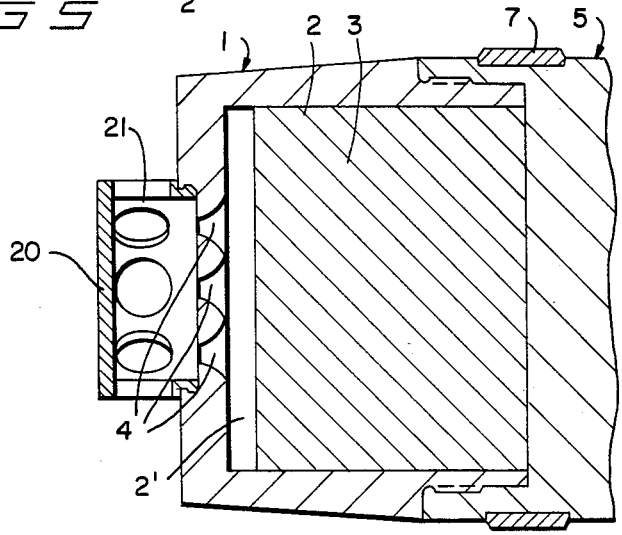
Figure 9:
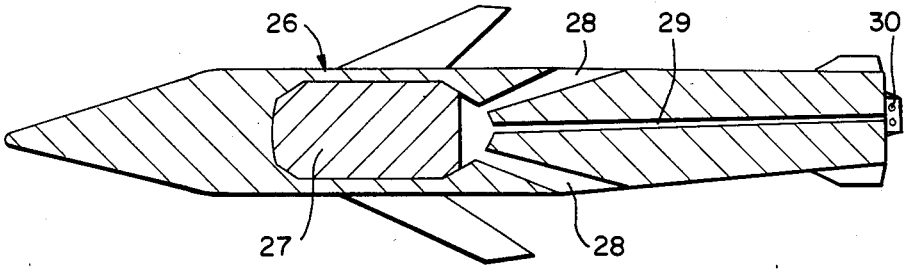

FIG. 8 illustrates how the invention principle is utilized for flying objects (missiles) having their own rocket motor. In a missile 26 equipped with a powder driven rocket motor 27 having two or more drive nozzles 28, a small amount of critically flowing combustion gases are drained from the combustion chamber of the powder driven rocket motor 27 via a channel 29. These combustion gases are led to the base of the missile where they in the manner described in connection with FIGS. 5–8 have most of their motive energy removed in the flame divider 30, after which the gases in already known ways are utilized to eliminate the base resistance. This variation can be suitably utilized in such missiles where the guidance system or other ground contact systems does not allow the rocket motor outlet nozzles to be located on the missile base.

We claim:

1. A device for reducing the base resistance of a projectile adapted to fly through the air and having a sheer base surface, said device comprising:

a combustion chamber for containing a propellant charge and having a discharge nozzle such that when said propellant charge is burned the combustion gases are discharged from said combustion chamber at a high speed faster than the speed of sound;

outlet means for causing said combustion gases to flow out to the atmosphere through said sheer base surface; and, means for reducing the speed of flow of said high speed combustion gases so that said outflowing gases have substantially no motive power when they reach the atmosphere, said speed reducing means comprising baffle means behind said sheer base surface for causing said combustion gases to change direction after passing through said sheer base surface.

2. A device according to claim 1 in which said baffle means includes a baffle member positioned directly across the flow path of combustion gases flowing through an opening in said sheer base surface.

3. A device according to claim 2 in which said outlet means includes a partition wall surrounding the sides of said baffle member and having radially arranged outflow openings.

4. A device according to claim 3 in which said baffle member has a cross-section much smaller than the sheer base surface of said projectile.

5. A device according to claim 1 in which said combustion gases are caused to change direction before passing through said sheer base surface by a bulkhead located directly across the path of the combustion gases flowing out of said combustion chamber through said discharge nozzle.

6. A device according to claim 1 in which said speed reducing means further comprises a chamber between said discharge nozzle and said outlet means of sufficient size relative to the quantity of said combustion gases to reduce the speed of flow of said high speed combustion gases to a speed substantially slower than the speed of sound.

7. A device according to claim 1 in which said baffle means causes at least a portion of said combustion gases to change direction by at least 90° before reaching the atmosphere.

* * * * *